United States Patent [19]

Ishikawa et al.

[11] Patent Number: 5,031,878

[45] Date of Patent: Jul. 16, 1991

[54] VALVE SEAT MADE OF SINTERED IRON BASE ALLOY HAVING HIGH WEAR RESISTANCE

[75] Inventors: Yoshimi Ishikawa; Osamu Mayama, both of Niigata, Japan

[73] Assignee: Mitsubishi Metal Corporation, Tokyo, Japan

[21] Appl. No.: 613,243

[22] Filed: Nov. 14, 1990

[30] Foreign Application Priority Data

Nov. 16, 1989 [JP] Japan ..... 1-298273

[51] Int. Cl.[5] ..... F01L 3/02; B22F 3/10

[52] U.S. Cl. ..... 251/368; 123/188 S; 75/246

[58] Field of Search ..... 75/243, 241, 246; 123/188 S; 251/368

[56] References Cited

U.S. PATENT DOCUMENTS

| | | | |
|---|---|---|---|
| 3,863,318 | 2/1975 | Niimi et al. | 75/243 |
| 4,204,031 | 5/1980 | Takemura et al. | 75/243 |
| 4,233,073 | 11/1980 | Takemura | 75/243 |
| 4,345,943 | 8/1982 | Takahashi et al. | 75/241 |
| 4,346,684 | 8/1982 | Vossteck | 123/188 S |
| 4,360,383 | 11/1982 | Takahashi et al. | 75/246 |
| 4,422,875 | 12/1983 | Nakata et al. | 123/188 S |
| 4,546,737 | 10/1985 | Kazuoka et al. | 123/188 S |
| 4,671,491 | 6/1987 | Kuroishi et al. | 123/188 S |
| 4,734,968 | 4/1988 | Kuroishi et al. | 123/188 S |
| 4,844,024 | 7/1989 | Fujiki et al. | 123/188 S |

FOREIGN PATENT DOCUMENTS

| | | | |
|---|---|---|---|
| 2918248 | 11/1980 | Fed. Rep. of Germany | 123/188 S |

*Primary Examiner*—A. Michael Chambers

*Attorney, Agent, or Firm*—Frishauf, Holtz, Goodman & Woodward

[57] ABSTRACT

This invention relates to valve seats that are made of a sintered Fe-base alloy that has high wear resistance, that is less hostile to valves and that hence is suitable for use with internal combustion engines such as diesel engines and gasoline engines, particularly those having high power outputs, the sintered Fe base alloy comprising a sintered Fe base alloy substrate having such a structure that hard particles A that contain 25–45% Cr, 20–30% W, 20–30% Co, 1–3% C, 0.2–2% Si and 0.2–2% Nb, with the balance being Fe and incidental impurities, and hard particles B that contain 55–65% Co, 25–32% Cr, 7–10% Mo and 1.5–3.5% Si, with the balance being Fe and incidental impurities, are dispersed in a total amount of 10–25% in an Fe base alloy matrix that contains 1–3% Cr, 0.5–3% Mo, 0.5–3% Ni, 2–8% Co, 0.6–1.5% C and 0.2–1% Nb, with the balance being Fe and incidental impurities, and which has a structure that is mainly composed of a pearlitic and a bainitic phase, all the percents being on a weight basis.

3 Claims, No Drawings

VALVE SEAT MADE OF SINTERED IRON BASE ALLOY HAVING HIGH WEAR RESISTANCE

BACKGROUND OF THE INVENTION

This invention relates to valve seats that are made of a sintered Fe-base alloy that has high wear resistance, that is less hostile to valve and that hence is suitable for use with internal combustion engines such as diesel engines and gasoline engines, particularly those having high power outputs.

Japanese Patent Public Disclosure No. 178073/1983 describes a valve seat made of a copper-impregnated Fe base alloy sinter that has Cu infiltrated in a sintered Fe base alloy substrate having a porosity of 6–14 vol % and structure such that Cr base alloy particles that contain 2–30% C (unless otherwise specified, all percents are by weight), 7–15% Co, 15–25% W and 1–8% Fe, with the balance being Cr and incidental impurities, and 8–12 vol % of Fe-Mo alloy particles are dispersed in an Fe base alloy matrix that contains 0.1–1.9% Mo, 0.5–2.5% Ni, 4.5–7.5% Co, 3–6.5% Cr, 0.5–1.7% C and 1–2.7% W, with the balance being Fe and incidental impurities.

Because of the use of superchargers and multiple valves, as well as the increase in rotational speeds, modern internal combustion engines are designed to produce higher power outputs, causing an ever growing increase in both thermal and mechanical loads. If such modern internal combustion engines are equipped with a valve seat made of the aforementioned conventional copper-impregnated Fe base alloy sinter, the Cr base alloy particles and Fe-Mo alloy particles dispersed in the Fe base alloy matrix, although they are very hard, have only poor adhesion to the Fe base alloy matrix and, during the operation of the engine, those alloy particles will be oxidized and dislodged, causing the valve seat to wear. Further, the dislodged alloy particles will also cause the mating valve to wear.

SUMMARY OF THE INVENTION

Under these circumstances, the present inventors conducted intensive studies in order to develop a valve seat that has a sufficient wear resistance to meet the demand of modern internal combustion engines for higher power outputs. As a result, the present inventors found that the above-stated object of this invention could be fully achieved by a valve seat made of a sintered Fe base alloy that comprises a sintered Fe base alloy substrate having such a structure that hard particles A that contain 25–45% Cr, 20–30% W, 20–30% Co, 1–3% C, 0.2–2% Si and 0.2–2% Nb, with the balance being Fe and incidental impurities, and hard particles B that contain 55–65% Co, 25–32% Cr, 7–10% Mo and 1.5–3.5% Si, with the balance being Fe and incidental impurities, are dispersed in a total amount of 10–25% in an Fe base alloy matrix that contains 1–3% Cr, 0.5–3% Mo, 0.5–3% Ni, 2–8% Co, 0.6–1.5% C and 0.2–1% Nb, with the balance being Fe and incidental impurities, and which has a structure that is mainly composed of a pearlitic and a bainitic phase, all the percents being on a weight basis.

The present invention has been accomplished on the basis of this finding. Also included within the scope of the present invention are the following two valve seats: a valve seat made of a sintered Fe base alloy that is composed of a copper-impregnated Fe base alloy sinter having 5–20 wt % Cu infiltrated in a sintered Fe base alloy substrate having the composition and structure described above; and a valve seat made of a sintered Fe base alloy that is composed of a lead-impregnated Fe base alloy sinter having 5–20 wt % Pb infiltrated in a sintered Fe base alloy substrate having the composition and structure described above.

DETAILED DESCRIPTION OF THE INVENTION

The criticality of each of the components in the sintered Fe base alloy substrate for the valve seat of the present invention is described below.

A. Components of the Fe Base Alloy Matrix

(a) C

The carbon (c) component binds with Mo and Cr to form carbides, thereby providing enhanced hardness. Further, carbon forms a pearlite- and bainite-based matrix to provide improved wear resistance. If the carbon content is less than 0.5 wt %, these effects will not be fully attained. If the carbon content exceeds 1.5 wt %, the matrix will become so hard as to increase the chance of attack on the mating valve. Hence, the carbon content is limited to be within the range of 0.6–1.5 wt %.

(b) Cr

The chromium (Cr) component dissolves in the matrix to improve its heat resistance. Further, it forms carbides to provide improved wear resistance. If the Cr content is less than 1 wt %, these effects will not be fully attained. If the Cr content exceeds 3 wt %, the sinterability of the matrix decreases to make it difficult to produce a sinter having high strength. Hence, the chromium content is limited to be within the range of 1–3 wt %.

(c) Mo

The molybdenum (Mo) component dissolves in the matrix to form carbides that contribute to an improved wear resistance. If the Mo content is less than 0.5 wt %, this effect will not be full attained. If the Mo content exceeds 3 wt %, the material strength of the matrix will decrease. Hence, the molybdenum content is limited to be within the range of 0.5–3 wt %.

(d) Ni

The nickel (Ni) component dissolves in the matrix to increase its strength. If the Ni content is less than 0.5 wt %, this effect will not be fully attained. If the Ni content exceeds 3 wt %, the effect is saturated and further addition of Ni is simply uneconomical. Hence, the nickel content is limited to be within the range of 0.5–3 wt %.

(e) Co

The cobalt (Co) component dissolves in the matrix to increase its strength. If the Co content is less than 2 wt %, this effect is not fully attained. If the Co content exceeds 8 wt %, the effect is saturated and further addition of Co is simply uneconomical. Hence, the cobalt content is limited to be within the range of 2–8 wt %.

(f) Nb

The niobium (Nb) component of the matrix forms a fine Cr-Nb carbides that dissolves in the matrix to improve its wear resistance. If the Nb content is less than 0.2 wt %, this effect is not fully attained. If the Nb content exceeds 1 wt %, the effect is saturated and further addition of Nb will not produce any corresponding improvement. Hence, the niobium content is limited to be within the range of 0.2–1 wt %.

B. Components of Hard Particles A (g) C

The carbon (C) component forms carbides to strengthen hard particles A. If the C content is less than 1 wt %, this effect is not fully attained. If the C content exceeds 3 wt %, the particles A become so hard as to increase the chance of valve attack. Hence, the carbon content is limited to be within the range of 1–3 wt %.

(h) Cr

The chromium (Cr) component dissolves in the matrix of hard particles A to improve their heat resistance. Further, Cr forms carbides and intermetallic compounds to provide improved wear resistance. If the Cr content is less than 25 wt %, these effects are not fully attained. If the Cr content exceeds 45 wt %, the hardness of the particles A and, hence, the chance of valve attack will increase. Therefore, the chromium content is limited to be within the range of 25–45 wt %.

(i) W

The tungsten (W) component forms carbides and intermetallic compounds in the matrix of the hard particles A, thereby improving their wear resistance. If the W content is less than 20 wt %, this effect is not fully attained. If the W content exceeds 30 wt %, the hardness of the particles A and, hence, the chance of valve attack will increase. Therefore, the tungsten content is limited to be within the range of 20–30 wt %.

(j) Nb

The niobium (Nb) component forms carbides in the matrix of hard particles A to improve their wear resistance and to enhance their adhesion to the Fe base alloy matrix. If the Nb content is less than 0.2 wt %, these effects are not fully attained. If the Nb content exceeds 2 wt %, the effects are simply saturated and further addition of Nb will reduce the wettability of the powder to be atomized. Hence, the niobium content is limited to be within the range of 0.2–2 wt %.

(k) Co

The cobalt (Co) component dissolves in the matrix of hard particles A to increase their strength and heat resistance. If the Co content is less than 20 wt %, these effects will not be fully attained. If the Co content exceeds 30 wt %, the effects are saturated and further addition of Co is simply uneconomical. Hence, the cobalt content is limited to be within the range of 20–30 wt %.

(l) Si

The silicon (Si) component forms carbides to improve the wear resistance of hard particles A. If the Si content is less than 0.2 wt %, this effect is not fully attained. If the Si content exceeds 2 wt %, the hard particles A will simply become brittle. Hence, the silicon content is limited to be within the range of 0.2–2 wt %.

C. Components of Hard Particles B (m) Cr

The chromium (Cr) component is capable of improving the heat resistance of hard particles B. In addition, it forms carbides and intermetallic compounds to improve the wear resistance of hard particles B and to enhance their adhesion to the Fe base alloy matrix. If the Cr content is less than 25 wt %, these effects will not be fully attained. If the Cr content exceeds 32 wt %, the effects are simply saturated and further addition of Cr will reduce the wettability of the powder to be atomized. Hence, the chromium content is limited to be within the range of 25–32%.

(n) Mo

The molybdenum (Mo) component dissolves in the matrix of hard particles B to form carbides that contribute to improved wear resistance. If the Mo content is less than 7 wt %, this effect is not fully attained. If the Mo content exceeds 10 wt %, the material strength of hard particles B will decrease. Hence, the molybdenum content is limited to be within the range of 7–10 wt %.

(o) Si

The silicon (Si) component forms intermetallic compounds to improve the wear resistance of hard particles B. If the Si content is less than 1.5 wt %, this effect is not fully attained. If the Si content exceeds 3.5 wt %, the chance of valve attack by the hard particles B will increase. Hence the silicon content is limited to be within the range of 1.5–3.5 wt %.

(p) Co

The cobalt (Co) component dissolves in the matrix of hard particles B to enhance their strength and heat resistance. If the Co content is less than 55 wt %, these effects will not be fully attained. If the Co content exceeds 65 wt %, the effects are simply saturated. Hence, in consideration of economy, the cobalt content is limited to be within the range of 55–65 wt %.

D. Why both hard particles A and B must be dispersed in the Fe base alloy matrix Hard particles A are inexpensive and provide high hardness. However, they are prone to oxidation and if they are oxidized, they will be dislodged from the matrix, making it impossible to impart desired wear resistance. On the other hand, hard particles B have high resistance to oxidation and are less hostile to the mating valve. However, hard particles B are expensive and are not as hard as particles A. If both hard particles A and B are dispersed in the matrix at the same time, particles B work effectively to prevent particles A from being dislodged upon oxidation. As a result, the wear resistance of the matrix is improved and at the same time, the chance of valve attack is reduced. However, if the sum of hard particles A and B is less than 10 wt % of the matrix, the above-described effects will not be fully attained. If the sum of hard particles A and B exceeds 25 wt %, the strength of the valve seat as the final product will decrease. Hence, the sum of hard particles A and B is limited to be within the range of 10–25 wt %.

E. Amount of Cu Infiltration

In accordance with the present invention, the voids in the sintered Fe base alloy substrate described herein may be infiltrated with copper so as to produce a valve seat that is further strengthened on account of the closure of the voids and which has even higher heat resistance on the basis of improved heat conductivity. If the amount of Cu infiltration is less than 5 wt %, these effects will not be fully attained. On the other hand, in order to achieve more than 20 wt % Cu infiltration, the porosity of the sintered Fe base alloy substrate must be increased. But then the increase in the porosity of the sintered Fe base alloy substrate will reduce the strength of the valve seat as the final product. Hence, the amount of Cu infiltration is limited to be within the range of 5-20 wt %.

F. Amount of Pb Infiltration

Further in accordance with the present invention, the voids in the sintered Fe base alloy substrate described herein may be infiltrated with lead so as to produce a valve seat that is further strengthened by the closure of the voids and which is even less hostile to the mating valve on account of the self-lubricating property of lead. If the amount of Pb infiltration is less than 5 wt %, these effects will not be fully attained. On the other hand, in order to achieve more than 20 wt % Pb infiltration, the porosity of the sintered Fe base alloy substrate must be increased. But then the increase in the porosity of the sintered Fe base alloy substrate will reduce the strength of the valve seat as the final product. Hence, the amount of Pb infiltration is limited to be within the range of 5-20 wt %.

In producing the valve seat of the present invention which is made of a highly wear resistant, sintered Fe base alloy as defined hereinabove, sintering is performed by holding either in vacuo or in a reducing gas atmosphere at a temperature of 1,100°-1,250° C. for a period of 1 hour. If Cu infiltration is to be performed, it may be accomplished by holding in a reducing gas atmosphere at a temperature of 1,090°-1,150° C. for a period of 20 minutes. If Pb infiltration is to be performed, it may be accomplished by holding in a neutral gas atmosphere at a temperature of 550°-700° C. for a period of 1 hour. If necessary, sintering, Cu infiltration or Pb infiltration is desirably followed by a heat treatment which involves holding at a temperature of 550°-750° C. for a period of 1 hour.

The following example is provided for the purpose of further illustrating the present invention but is in no way to be taken as limiting.

EXAMPLE

The following starting powders each having a grain size of −100 mesh were provided: an Fe-1% Cr powder, an Fe-13% Cr-5% Nb powder, a carbonyl powder, a Co powder, a Mo powder, and a native graphite powder. Also provided were Cr base hard particles and Co base hard particles that had the compositions shown in Table 1 below. Those starting powders and Cr- and Co-base hard particles were weighed in the amounts shown in Table 1, mixed together and compressed at pressures of 6-6.5 t/cm$^2$. The compacts were degreased by holding at 500° C. for 30 minutes and thereafter calcined by holding in ammonia decomposition gases at 700°-900° C. for half an hour. The calcined products were cold forged to have densities of 7.0 g/cm$^3$ and more. They were again degreased and sintered by holding in ammonia decomposition gases at 1,100°-1,250° C. for 1 hour. The sinters were heat-treated, as required for hardness adjustment and structure stabilization, by holding in ammonia decomposition gases at 550°-750° C. for 1 hour. By these procedures, valve seat samples 1-22 made of the sintered Fe base alloys of the present invention (which are hereunder referred to as "the valve seats of the present invention") and additional valve seat samples 1-16 made of comparative sintered Fe base alloys (which are hereunder referred to as "the comparative valve seats") were produced; each of these valves had an outside diameter of 34 mm, and inside diameter of 26 mm and a height of 7.2 mm.

Additional valve seats having the same dimensions and composition as valve seat sample 1 of the present invention were infiltrated with Cu by holding in a modified methane gas atmosphere at 1,110° C. for 20 minutes and further tempered in air atmosphere at 620° C. for 1 hour, thereby producing valve seat samples 23 and 24 of the present invention and comparative valve seat sample 17.

Two more valve seats having the same dimensions and composition as valve seat sample 1 of the present invention were infiltrated with Pb by holding in a nitrogen gas atmosphere at 650° C. for 1 hour, thereby producing valve seat sample 25 of the present invention and comparative valve seat sample 18.

The comparative valve seat samples were such that the value for either one of the constitutional elements was outside the ranges specified by the present invention (in Table 1, every one of such non-compliant values is marked with an asterisk).

For further comparison, a prior art valve seat was also provided.

The valve seats thus provided were subjected to a wear test under the conditions set forth below and their wear resistance was evaluated by measuring the depth of maximum wear that occurred in each valve seat. Further, the attack on a SUH-36 valve by each valve seat was evaluated by measuring the depth of maximum wear that occurred in that valve. The results of these evaluations are shown in Table 1.

Wear test conditions

Valve material: SUH-36

Valve heating temperature: 900° C.

Valve seating times: 3000 per minute Atmosphere: Gases produced by combustion of propane gas (0.4 kg/cm$^2$) with oxygen gas supplied at a flow rate of 1.5 L/min Valve seat heating temperature (water-cooled): 250°-300° C.

Seating Load: 30 kg

Test period: 100 hours

TABLE 1-1

| | Valve seat made of sintered Fe base alloy Sintered Fe base alloy substrate (wt %) | | | | | | | | | | | | | | | |
|---|---|---|---|---|---|---|---|---|---|---|---|---|---|---|---|---|
| | Composition (wt %) | | | | | | | Fe base alloy | Composition (wt %) | | | | | | | Hard particles |
| Sample No. | Cr | Mo | Ni | Co | Nb | C | Fe | matrix | Cr | W | Co | C | Si | Nb | Fe | A |
| Valve seat of the invention | | | | | | | | | | | | | | | | |
| 1 | | | | | | | | bal. | 35 | 25 | 25 | 2.5 | 1.0 | 1.0 | bal. | 9.0 |

TABLE 1-1-continued

| | Valve seat made of sintered Fe base alloy Sintered Fe base alloy substrate (wt %) | | | | | | | | | | | | | | | |
|---|---|---|---|---|---|---|---|---|---|---|---|---|---|---|---|---|
| | Composition (wt %) | | | | | | | Fe base alloy | Composition (wt %) | | | | | | | Hard particles |
| Sample No. | Cr | Mo | Ni | Co | Nb | C | Fe | matrix | Cr | W | Co | C | Si | Nb | Fe | A |
| 2 | | | | | | | | bal. | 35 | 25 | 25 | 2.5 | 1.0 | 1.0 | bal. | 6.0 |
| 3 | | | | | | | | bal. | 35 | 25 | 25 | 2.5 | 1.0 | 1.0 | bal. | 12.0 |
| 4 | | | | | | | | bal. | 26 | 25 | 25 | 2.5 | 1.0 | 1.0 | bal. | 9.0 |
| 5 | | | | | | | | bal. | 44 | 25 | 25 | 2.5 | 1.0 | 1.0 | bal. | 9.0 |
| 6 | | | | | | | | bal. | 35 | 22 | 25 | 2.5 | 1.0 | 1.0 | bal. | 9.0 |
| 7 | 1.8 | 1.5 | 1.5 | 5.0 | 0.5 | 1.0 | bal. | bal. | 35 | 29 | 25 | 2.5 | 1.0 | 1.0 | bal. | 9.0 |
| 8 | | | | | | | | bal. | 35 | 25 | 21 | 2.5 | 1.0 | 1.0 | bal. | 9.0 |
| 9 | | | | | | | | bal. | 35 | 25 | 28 | 2.5 | 1.0 | 1.0 | bal. | 9.0 |
| 10 | | | | | | | | bal. | 35 | 25 | 25 | 1.1 | 1.0 | 1.0 | bal. | 9.0 |
| 11 | | | | | | | | bal. | 35 | 25 | 25 | 2.8 | 1.0 | 1.0 | bal. | 9.0 |
| 12 | | | | | | | | bal. | 35 | 25 | 25 | 2.5 | 0.6 | 1.0 | bal. | 9.0 |
| 13 | | | | | | | | bal. | 35 | 25 | 25 | 2.5 | 1.8 | 1.0 | bal. | 9.0 |
| 14 | | | | | | | | bal. | 35 | 25 | 25 | 2.5 | 1.0 | 0.3 | bal. | 9.0 |
| 15 | | | | | | | | bal. | 35 | 25 | 25 | 2.5 | 1.0 | 1.9 | bal. | 9.0 |
| 16 | | | | | | | | bal. | 35 | 25 | 25 | 2.5 | 1.0 | 1.0 | bal. | 9.0 |
| 17 | | | | | | | | bal. | 35 | 25 | 25 | 2.5 | 1.0 | 1.0 | bal. | 9.0 |
| 18 | | | | | | | | bal. | 35 | 25 | 25 | 2.5 | 1.0 | 1.0 | bal. | 9.0 |
| 19 | | | | | | | | bal. | 35 | 25 | 25 | 2.5 | 1.0 | 1.0 | bal. | 9.0 |
| 20 | 1.8 | 1.5 | 1.5 | 5.0 | 0.5 | 1.0 | bal. | bal. | 35 | 25 | 25 | 2.5 | 1.0 | 1.0 | bal. | 9.0 |
| 21 | | | | | | | | bal. | 35 | 25 | 25 | 2.5 | 1.0 | 1.0 | bal. | 9.0 |
| 22 | | | | | | | | bal. | 35 | 25 | 25 | 2.5 | 1.0 | 1.0 | bal. | 9.0 |
| 23 | | | | | | | | bal. | 35 | 25 | 25 | 2.5 | 1.0 | 1.0 | bal. | 9.0 |
| 24 | | | | | | | | bal. | 35 | 25 | 25 | 2.5 | 1.0 | 1.0 | bal. | 9.0 |
| 25 | | | | | | | | bal. | 35 | 25 | 25 | 2.5 | 1.0 | 1.0 | bal. | 9.0 |
| Comparative valve seat | | | | | | | | | | | | | | | | |
| 1 | | | | | | | | bal. | 35 | 25 | 25 | 2.5 | 1.0 | 1.0 | bal. | 3.0 |
| 2 | | | | | | | | bal. | 35 | 25 | 25 | 2.5 | 1.0 | 1.0 | bal. | 14.0 |
| 3 | | | | | | | | bal. | 20* | 25 | 25 | 2.5 | 1.0 | 1.0 | bal. | 9.0 |
| 4 | | | | | | | | bal. | 35 | 15* | 25 | 2.5 | 1.0 | 1.0 | bal. | 9.0 |
| 5 | | | | | | | | bal. | 35 | 35* | 25 | 2.5 | 1.0 | 1.0 | bal. | 9.0 |
| 6 | 1.8 | 1.5 | 1.5 | 5.0 | 0.5 | 1.0 | bal. | bal. | 35 | 25 | 15* | 2.5 | 1.0 | 1.0 | bal. | 9.0 |
| 7 | | | | | | | | bal. | 35 | 25 | 35* | 2.5 | 1.0 | 1.0 | bal. | 9.0 |
| 8 | | | | | | | | bal. | 35 | 25 | 25 | 3.5* | 1.0 | 1.0 | bal. | 9.0 |
| 9 | | | | | | | | bal. | 35 | 25 | 25 | 2.5 | 2.5* | 1.0 | bal. | 9.0 |
| 10 | | | | | | | | bal. | 35 | 25 | 25 | 2.5 | 1.0 | 2.5* | bal. | 9.0 |
| 11 | | | | | | | | bal. | 35 | 25 | 25 | 2.5 | 1.0 | 1.0 | bal. | 9.0 |
| 12 | | | | | | | | bal. | 35 | 25 | 25 | 2.5 | 1.0 | 1.0 | bal. | 9.0 |
| 13 | | | | | | | | bal. | 35 | 25 | 25 | 2.5 | 1.0 | 1.0 | bal. | 9.0 |
| 14 | | | | | | | | bal. | 35 | 25 | 25 | 2.5 | 1.0 | 1.0 | bal. | 9.0 |
| 15 | 1.8 | 1.5 | 1.5 | 5.0 | 0.5 | 1.0 | bal. | bal. | 35 | 25 | 25 | 2.5 | 1.0 | 1.0 | bal. | 9.0 |
| 16 | | | | | | | | bal. | 35 | 25 | 25 | 2.5 | 1.0 | 1.0 | bal. | 9.0 |
| 17 | | | | | | | | bal. | 35 | 25 | 25 | 2.5 | 1.0 | 1.0 | bal. | 9.0 |
| 18 | | | | | | | | bal. | 35 | 25 | 25 | 2.5 | 1.0 | 1.0 | bal. | 9.0 |
| Prior art valve seat | — | 0.5 | 1.5 | 6.0 | — | 1.0 | bal. | bal. | 5.2 | 20.6 | 12.4 | 2.5 | — | — | bal. | 10.0 |

*indicates non-compliance with the invention

TABLE 1-2

| | Valve seat made of sintered Fe base alloy | | | | | | | | | | |
|---|---|---|---|---|---|---|---|---|---|---|---|
| | Sintered Fe base alloy substrate (wt %) | | | | | | | Amount of Cr or Pb infiltration in sintered Fe base alloy substrate (wt %) | | Results of valve seat | |
| | Composition (wt %) | | | | | Hard particles | Sum of hard particles A and B | | | Depth of maximum wear in valve seat | Depth of maximum wear in SUH-36 |
| Sample No. | Co | Cr | Mo | Si | Fe | B | (wt %) | Cu | Pb | (μm) | valve (μm) |
| Valve seat of the invention | | | | | | | | | | | |
| 1 | 58.0 | 28.5 | 8.5 | 2.5 | bal. | 9.0 | 18.0 | — | — | 40 | 60 |
| 2 | 58.0 | 28.5 | 8.5 | 2.5 | bal. | 6.0 | 12.0 | — | — | 30 | 90 |
| 3 | 58.0 | 28.5 | 8.5 | 2.5 | bal. | 12.0 | 24.0 | — | — | 60 | 70 |
| 4 | 58.0 | 28.5 | 8.5 | 2.5 | bal. | 9.0 | 18.0 | — | — | 20 | 100 |
| 5 | 58.0 | 28.5 | 8.5 | 2.5 | bal. | 9.0 | 18.0 | — | — | 60 | 70 |
| 6 | 58.0 | 28.5 | 8.5 | 2.5 | bal. | 9.0 | 18.0 | — | — | 30 | 100 |
| 7 | 58.0 | 28.5 | 8.5 | 2.5 | bal. | 9.0 | 18.0 | — | — | 50 | 60 |
| 8 | 58.0 | 28.5 | 8.5 | 2.5 | bal. | 9.0 | 18.0 | — | — | 60 | 70 |
| 9 | 58.0 | 28.5 | 8.5 | 2.5 | bal. | 9.0 | 18.0 | — | — | 20 | 50 |
| 10 | 58.0 | 28.5 | 8.5 | 2.5 | bal. | 9.0 | 18.0 | — | — | 20 | 120 |
| 11 | 58.0 | 28.5 | 8.5 | 2.5 | bal. | 9.0 | 18.0 | — | — | 70 | 70 |
| 12 | 58.0 | 28.5 | 8.5 | 2.5 | bal. | 9.0 | 18.0 | — | — | 40 | 80 |

TABLE 1-2-continued

| | Valve seat made of sintered Fe base alloy | | | | | | | | | | |
|---|---|---|---|---|---|---|---|---|---|---|---|
| | Sintered Fe base alloy substrate (wt %) | | | | | | | Amount of Cr or Pb infiltration in sintered Fe base alloy substrate (wt %) | | Results of valve seat | |
| | Composition (wt %) | | | | | Hard particles | Sum of hard particles A and B | | | Depth of maximum wear in valve seat | Depth of maximum wear in SUH-36 |
| Sample No. | Co | Cr | Mo | Si | Fe | B | (wt %) | Cu | Pb | (μm) | valve (μm) |
| 13 | 58.0 | 28.5 | 8.5 | 2.5 | bal. | 9.0 | 18.0 | — | — | 60 | 70 |
| 14 | 58.0 | 28.5 | 8.5 | 2.5 | bal. | 9.0 | 18.0 | — | — | 30 | 90 |
| 15 | 58.0 | 28.5 | 8.5 | 2.5 | bal. | 9.0 | 18.0 | — | — | 50 | 60 |
| 16 | 56.0 | 28.5 | 8.5 | 2.5 | bal. | 9.0 | 18.0 | — | — | 30 | 100 |
| 17 | 58.0 | 25.5 | 8.5 | 2.5 | bal. | 9.0 | 18.0 | — | — | 30 | 100 |
| 18 | 58.0 | 30.5 | 8.5 | 2.5 | bal. | 9.0 | 18.0 | — | — | 60 | 50 |
| 19 | 58.0 | 28.5 | 7.0 | 2.5 | bal. | 9.0 | 18.0 | — | — | 20 | 80 |
| 20 | 58.0 | 28.5 | 9.5 | 2.5 | bal. | 9.0 | 18.0 | — | — | 30 | 80 |
| 21 | 58.0 | 28.5 | 8.5 | 3.0 | bal. | 9.0 | 18.0 | — | — | 40 | 70 |
| 22 | 58.0 | 28.5 | 8.5 | 1.6 | bal. | 9.0 | 18.0 | — | — | 40 | 80 |
| 23 | 58.0 | 28.5 | 8.5 | 1.6 | bal. | 9.0 | 18.0 | 13.3 | — | 30 | 40 |
| 24 | 58.0 | 28.5 | 8.5 | 1.6 | bal. | 9.0 | 18.0 | 18.8 | — | 20 | 60 |
| 25 | 58.0 | 28.5 | 8.5 | 1.6 | bal. | 9.0 | 18.0 | — | 12.1 | 20 | 50 |
| Comparative valve seat | | | | | | | | | | | |
| 1 | 58.0 | 28.5 | 8.5 | 1.6 | bal. | 3.0 | 6.0* | — | — | 40 | 270 |
| 2 | 58.0 | 28.5 | 8.5 | 1.6 | bal. | 14.0 | 28.0* | — | — | 120 | 110 |
| 3 | 58.0 | 28.5 | 8.5 | 1.6 | bal. | 9.0 | 18.0 | — | — | 60 | 80 |
| 4 | 58.0 | 28.5 | 8.5 | 1.6 | bal. | 9.0 | 18.0 | — | — | 50 | 170 |
| 5 | 58.0 | 28.5 | 8.5 | 1.6 | bal. | 9.0 | 18.0 | — | — | 80 | 150 |
| 6 | 58.0 | 28.5 | 8.5 | 2.5 | bal. | 9.0 | 18.0 | — | — | 60 | 150 |
| 7 | 58.0 | 28.5 | 8.5 | 2.5 | bal. | 9.0 | 18.0 | — | — | 30 | 90 |
| 8 | 58.0 | 28.5 | 8.5 | 2.5 | bal. | 9.0 | 18.0 | — | — | 150 | 120 |
| 9 | 58.0 | 28.5 | 8.5 | 2.5 | bal. | 9.0 | 18.0 | — | — | 110 | 140 |
| 10 | 58.0 | 28.5 | 8.5 | 2.5 | bal. | 9.0 | 18.0 | — | — | 70 | 150 |
| 11 | 58.0 | 15* | 8.5 | 2.5 | bal. | 9.0 | 18.0 | — | — | 30 | 210 |
| 12 | 49* | 35* | 8.5 | 2.5 | bal. | 9.0 | 18.0 | — | — | 90 | 120 |
| 13 | 58.0 | 28.5 | 4* | 2.5 | bal. | 9.0 | 18.0 | — | — | 30 | 190 |
| 14 | 58.0 | 28.5 | 15* | 2.5 | bal. | 9.0 | 18.0 | — | — | 100 | 120 |
| 15 | 58.0 | 28.5 | 8.5 | 5.0* | bal. | 9.0 | 18.0 | — | — | 80 | 120 |
| 16 | 50.5* | 28.5 | 8.5 | 2.5 | bal. | 9.0 | 18.0 | — | — | 70 | 180 |
| 17 | 58.0 | 28.5 | 8.5 | 2.5 | bal. | 9.0 | 18.0 | 25.1* | — | 40 | 220 |
| 18 | 58.0 | 28.5 | 8.5 | 2.5 | bal. | 9.0 | 18.0 | — | 24.3* | 30 | 210 |
| Prior art valve seat | — | — | — | — | — | — | 10.0 | 13.8 | — | 50 | 200 |

*indicates non-compliance with the invention

The date in Table 1 shows that the valve seat samples of the present invention caused less attack on the SUH-36 valve than the prior art valve seat. Further, as is evidenced by the comparative valve seat samples, non-compliance with the requirements of the present invention caused deterioration in either one of the following three characteristics: wear resistance of the valve seat, its attack on the valve, and the sum of the valve seat wear and the valve attack.

As will be apparent from the foregoing description, the valve seat that is made of the sintered Fe base alloy specified herein has high wear resistance and causes less attack on the mating valve and, hence, it will exhibit excellent performance over a prolonged time when used as a valve seat in a high-power internal combustion engine.

In the example described above, the valve seat of the present invention which is made of the highly wear-resistant, sintered Fe base alloy specified herein is produced by the sequence of calcination, cold forging and sintering steps. It should, however, be noted that this is not the sole method for producing the valve seat of the present invention, and other methods that can be employed include the combination of primary sintering, hot forging and secondary sintering, as well as the customary process which involves the sintering of a compact.

What is claimed is:

1. A highly wear-resistant valve seat made of a sintered Fe base alloy that comprises a sintered Fe base alloy substrate having such a structure that hard particles A that contain 25–45% Cr, 20–30% W, 20–30% Co, 1–3% C, 0.2–2% Si and 0.2–2% Nb, with the balance being Fe and incidental impurities, and hard particles B that contain 55–65% Co, 25–32% Cr, 7–10% Mo and 1.5–3.5% Si, with the balance being Fe and incidental impurities, are dispersed in a total amount of 10–25% in an Fe base alloy matrix that contains 1–3% Cr, 0.5–3% Mo, 0.5–3% Ni, 2–8% Co, 0.6–1.5% C and 0.2–1% Nb, with the balance being Fe and incidental impurities, and which has a structure that is mainly composed of a pearlitic and a bainitic phase, all the percents being on a weight basis.

2. A highly wear resistant valve seat which is composed of a copper-impregnated Fe base alloy sinter having 5–20 wt % Cu infiltrated in the sintered Fe base alloy substrate recited in claim 1.

3. A highly wear resistant valve seat which is composed of a lead-impregnated Fe base alloy sinter having 5–20 wt % Pb infiltrated in the sintered Fe base alloy substrate recited in claim 1.

* * * * *